US006631762B2

(12) United States Patent
Collette

(10) Patent No.: US 6,631,762 B2
(45) Date of Patent: Oct. 14, 2003

(54) SYSTEM AND METHOD FOR THE PRODUCTION OF OIL FROM LOW VOLUME WELLS

(76) Inventor: Herman D. Collette, P.O. Box 60605, Houston, TX (US) 77205

( * ) Notice: Subject to any disclaimer, the term of this patent is extended or adjusted under 35 U.S.C. 154(b) by 12 days.

(21) Appl. No.: 09/903,169

(22) Filed: Jul. 11, 2001

(65) Prior Publication Data

US 2003/0010491 A1 Jan. 16, 2003

(51) Int. Cl.[7] ..... E21B 43/12
(52) U.S. Cl. ..... 166/250.15; 53/105
(58) Field of Search ..... 166/250.03, 250.15, 166/369, 53, 105

(56) References Cited

U.S. PATENT DOCUMENTS

| | | | | | |
|---|---|---|---|---|---|
| 3,824,851 | A | | 7/1974 | Hagar et al. | 73/151 |
| 4,125,163 | A | * | 11/1978 | Fitzpatrick | 166/314 |
| 4,570,718 | A | | 2/1986 | Adams, Jr. | 166/369 |
| 4,599,046 | A | | 7/1986 | James | 417/44 |
| 4,747,451 | A | | 5/1988 | Adams, Jr. et al. | 166/53 |
| 4,767,280 | A | | 8/1988 | Markuson et al. | 417/44 |
| 4,830,113 | A | | 5/1989 | Geyer | 166/369 |
| RE33,690 | E | | 9/1991 | Adams, Jr. et al. | 166/53 |
| 5,193,985 | A | * | 3/1993 | Escue et al. | 417/53 |
| 5,222,867 | A | * | 6/1993 | Walker, Sr. et al. | 417/12 |
| 5,251,696 | A | | 10/1993 | Boone et al. | 166/250 |
| 5,318,409 | A | | 6/1994 | London et al. | 417/53 |
| 5,372,482 | A | | 12/1994 | London et al. | 417/12 |
| 5,425,623 | A | | 6/1995 | London et al. | 417/18 |
| 5,984,641 | A | | 11/1999 | Bevan et al. | 417/32 |
| 5,988,992 | A | * | 11/1999 | Tetzlaff et al. | 417/360 |
| 6,041,856 | A | * | 3/2000 | Thrasher et al. | 166/53 |
| 6,142,237 | A | * | 11/2000 | Christmas et al. | 166/376 |
| 6,468,058 | B1 | * | 10/2002 | Breit et al. | 417/423.3 |

* cited by examiner

*Primary Examiner*—William Neuder
(74) *Attorney, Agent, or Firm*—Browning Bushman P.C.

(57) ABSTRACT

An oil well pumping system includes a small positive displacement pump below the fluid interface in a low volume oil well which pumps at a rate to maintain approximately constant fluid level in the well. The system includes at least a pair of sensors in a sensor array that is positioned above the pump and near the fluid interface to unambiguously determine liquid level. By maintaining the pumping rate of the positive displacement pump below that required to lower the liquid level to the pump, the pump will not unload and pump power requirements are reduced to a nearly constant low rate. In addition, the pump off control function is accomplished by a microprocessor which is mounted adjacent to the downhole sensor array. This location allows simple direct control of the downhole electric motor and eliminates the requirement that a control element be placed on the surface far from the pump.

18 Claims, 6 Drawing Sheets

120
170
172
REG.
5V
174
68
190
188
158
COUNTER
OSC.
DRIVE MOTOR
70
5V
MPU
178
160
176
184
182
COUNTER
DISCR.
186
180

POWER ON DELAY 5 sec
200
WAIT
208
CHECK FLUID LEVEL SENSOR
202
204
FLUID LEVEL OK ?
NO
REPORT STATUS
206
YES
BEGIN MOTOR POWER PHASE MODULATION START
210
STABILIZE MOTOR AT MAX.
212
WAIT
214
CHECK FLUID LEVEL SENSOR
216
TO FIG. 6B

SYSTEM AND METHOD FOR THE PRODUCTION OF OIL FROM LOW VOLUME WELLS

FIELD OF THE INVENTION

The present invention relates to the field of oil pumping systems and, more particularly, to a system and method for the cost-effective production of oil from economically marginal, low volume oil wells.

BACKGROUND OF THE INVENTION

Three pumping methods are typically used in low pressure or no-pressure wells for lifting crude oil and water from subsurface formations to the surface. For low volume wells at relatively shallow depths, nearly all wells are pumped using beam pumping units. Beam pumping units trace their origin to "pitcher pumps" found on farms in rural areas in Europe and the United States in the $18^{th}$ and early $19^{th}$ century. For residential and commercial water supply, such pitcher pumps have largely been replaced by water distribution systems from municipal sources. However, the principle of using a rod to reciprocate a positive displacement pump element found application in lifting crude oil and produced water in oil fields and has been one of the three major lift methods employed world wide since 1912.

Today, beam pumping units used in oil production are part of a pumping system that employs pump off controllers that have either timers or other sensors located near the well head. When timers are employed, the pump is operated periodically at a rate that approximates the rate the well fills from natural drainage from the formation. Pump off controllers based on weight or power sensors operate the pump until a change in pump load is detected indicating that the pumping operation is no longer lifting fluid.

Many attempts have been made to improve the overall efficiency of beam pumping units by improving the pump off control system. However, these systems continue to rely on measurements of the surface observable characteristics of the pump or on surface control of the driving motor. Various improvements to these two basic techniques have been proposed. For example, U.S. Pat. No. 5,984,641 to Bevan, et al. teaches a controller for controlling the pump unit of an oil well which includes a sensor having probes in the flow of oil from the well bore to determine oil flow rate. A pump control signal is generated in response to the flow rate, and the pump control signal varies a predetermined parameter of a pumping unit during operation.

Other systems operate on other surface measured characteristics such as pump rod loading, such as for example U.S. Pat. No. 3,824,851 to Hahar, and drive motor power. In contrast, Adams, Jr.; in U.S. Pat. No. 4,570,718; proposed a system for controlling production in an oil well which included a surface-located controller for activating the means for causing reciprocation of the sucker rod of a beam pumping unit. A sensor was secured to the outer surface of the production tubing near the lower end of the tubing. The sensor comprised a radioactive source spaced from a radioactivity detector such that oil at that level would fill the space. Oil in the space would modify the amount of radioactivity sensed by the detector, and provide some indication of the level of oil in the well.

A principal drawback of such systems is that they draw an inordinate amount of power in order to operate, and when such wells produce only limited quantities of oil, they quickly become uneconomical. When such marginal or low volume wells cannot justify the cost of the installation and operation of the lifting system, they are typically closed in, even though there may be large quantities of hydrocarbons left underground.

Low volume wells typically produce less than 20 barrels ("bbl") of total fluid (oil and water) per day. Lifting 20 bbl of fluid a height of 1000 feet over a period of 20 hours typically requires 5 to 20 Hp in beam pumping systems. Further, such beam pumping units suffer increasing power requirements to operate the rod string, stuffing box, and to overcome viscous forces of the fluid at greater depths. In low volume wells, power losses in the stuffing box can exceed the actual power required to lift the fluid. Since production tubing is rarely sufficiently straight to allow the rod string to reciprocate without contacting the tubing, significant wear on both production tubing and the rod string is common, even with rod guides installed on the sucker rod.

In conventional beam pumping systems, the fluid is removed from a well in the annulus between the reciprocating rod string and a conduit of production tubing attached to the downhole pump. Geyer; in U.S. Pat. No. 4,830,113; recognized this phenomenon and proposed a small down hole pump and a relatively small motor as a replacement for the existing system. The Geyer system, however, met with two operational problems. First, the Geyer system required coil tubing as the production conduit. Most existing oil field tubulars consist of segments of steel pipe which precludes the cable installation method of Geyer as the tubular must be separated into segments during removal from the well. In contrast, the present invention uses a method which allows installation of the power cable after the production string is installed into the well. Second, the Geyer system provided no improvement over conventional provisions for the control of the down hole apparatus. Detection of the pump off condition in Geyer was accomplished by sensing changes in the required power. The present invention, however, uses sensors located near the pump to determine the level and condition of the fluid to be pumped. By employing a closed loop control scheme, the fluid level can be maintained within a specified range above the pump.

Many different pump off controllers have been proposed in the art, and many such controllers have been installed for production from low volume wells. For low volume wells which are typically pumped with beam pumps, pump off control methods depend on recognition of pump loading either through direct measurement of forces on the sucker rod or these methods rely on various schemes to control the pump using the motor loading. In some systems, a direct measurement of well fluid level is attempted, such as in Adams, Jr. as previously described. In these systems, either a conductive liquid is required and the only liquid level that can therefore be detected is produced brine or a single physical parameter is measured which leads to ambiguity in the determination of liquid level. This ambiguity results from the varying makeup of produced fluids from a pumping well, including often unpredictable mixtures of oil, water, brine of varying salinity, and various gases.

In some areas a well may produce a frothy crude oil mixed with oil field brine. In this type of production, it is impossible to determine the liquid level below the foam using reflective acoustic measurement because of the attenuation of the transmitted acoustic signal in the foam. Entrained gas in the froth above the oil/water liquid level also has an unpredictable effect on both velocity and amplitude of the transmitted acoustic signal and thus renders such measurements inaccurate.

Attempts to unambiguously determine the liquid level by measurement of a dielectric constant have also failed because the produced fluid typically contains three constituents in a pumped off well. These constituents are gas, oil, and water of varying salinity. Combinations of the dielectric properties of these three constituents may result in multiple combinations having the same dielectric constant.

Attempts to directly measure electron density by gamma ray attenuation have encountered limitations resulting from the varying density of produced crude oils over the life of an oil well. Occasionally, produced crude oils have the same density as water. And, over the life of an oil well the effervescence of produce crude may change. This results in a variation of oil density and ultimately the ability to determine fluid level from density measurements alone. It may be possible to employ neutron diffusion differences to unambiguously determine hydrogen density and infer a liquid level. However, this type of measurement system would require either a long lived chemical radiation source or installation of a neutron generator near the desired liquid level. Chemical radiation sources pose a long term contamination risk making this solution unacceptable and current neutron generators have too short a life to be considered for semi-permanent installation.

Thus, there remains a need for an efficient means of pumping oil from low volume wells. Such a system should preferably include a means for unambiguously determining liquid level within the well, in order to pump from the well at a rate to maintain approximately constant liquid level.

SUMMARY OF THE INVENTION

The present invention addresses these and other drawbacks in the art by providing a small positive displacement pump below the fluid interface in a low volume oil well. The system includes at least a pair of sensors in a sensor array that is positioned above the pump and near the fluid interface to unambiguously determine liquid level. By maintaining the pumping rate of the positive displacement pump below that required to lower the liquid level to the pump, the pump will not unload and pump power requirements are reduced to a nearly constant low rate. In addition, the pump off control function is accomplished by a microprocessor which is mounted adjacent to the downhole sensor array. This location allows simple direct control of the downhole electric motor and eliminates the requirement that a control element be placed on the surface far from the pump.

It is therefore an object of the present invention to reduce the cost of producing liquids from low volume wells. In accordance with this invention, fluids such as water and/or oil and/or natural gas are produced out of the well within a substantially annular space between a conduit typically formed from a string of production tubulars and the power delivery cable. The power delivery cable is included in an armored wireline and provides power to the pump, the pump off controller, and the sensors.

In high volume wells typically pumped using centrifugal pumps, electrical power is provided to the downhole motor via electrical cable suspended in the annulus between the production tubing and the well casing. This arrangement is advantageous for two reasons. First, the production tubing is typically assembled in joints approximately 30 feet in length. It is more convenient to pass the cable into the well from a continuous spool when installing the production tubular than to install the cable within the production tubular by pulling the entire length of cable through each joint of the production tubular string during installation. Second, the rate of production of fluid from wells pumped using downhole centrifugal pumps is sufficiently high that the flow of fluid from the well is turbulent from the exit of the pump to the surface. With this flow velocity, friction on a cable suspended within the production tubular is significant and will result in vibration and destruction of the connecting power cable. Installation of power connections at multiple positions within the production tubular have been attempted without commercial success due to compounding of the potential for failure with each of multiple connections.

It is therefore another object of the present invention to provide low cost installation of an oil pumping system that is compatible with existing hardware. This means using existing well production tubulars and a way to the power cable into a tubing string without the laborious task of threading cable through each joint before installing the joint into the well. To this end, a single "wet connect" of the type typically used in connection of instrument packages during directional well drilling applications is used to make a single downhole connection to the pump and sensor assembly using a cable suspended within the production tubular. Because the system of the invention is intended to support low production rates, the velocities obtained by pump fluids are typically very low, typically less than 0.25 ft/sec. At these rates, viscous fluids of the type this invention addresses approach 'creep flow' and friction at the surface of the production tubular or at the surface of the power cable is minimal and therefore, so is the tendency for vibrational failure of the power cable.

It is a further object of the invention to provide local, continuous pump off control so that the level of fluid in the well is held at a nearly constant level above the pump and below the static liquid level supplied by formation pressure. To accomplish this, a minimum of two sensors are placed within a sleeve that surrounds the production conduit. These sensors are preferably a fluid density gauge and a capacitance gauge. However, sensors that measure a physical parameter of the fluid column that varies so that the sensors can differentiate between oil and/or water level with varying quantities of emulsified gas or foam can be used. In the case of the fluid density sensor, an elongated container of a radioactive mineral or other radioactive material is mounted axially on the sleeve. This container is parallel to an open channel open to the annulus between the production conduit and the well casing and through which the well bore fluid may pass.

A long radiation detector, for example a Geiger-Mueller (G-M) counter, is parallel to the open channel and on the opposite side of the open channel from the elongated container containing the radioactive material. AG-M counter is a radiation detection and measuring instrument which consists of a gas-filled tube containing electrodes, between which there is an electrical voltage, but no current flowing. When ionizing radiation passes through the tube, a short, intense pulse of current passes from the negative electrode to the positive electrode and is measured or counted. The number of pulses per second measures the intensity of the radiation field. By accurate calibration of the radiation attenuation across the channel caused by the liquid and froth in the channel, the average electron density of the fluid within the channel can be determined. For most mixtures of crude oil, water, and natural gas this electron density is directly correlatable to a narrow range of liquid levels.

Similarly, a second open channel is constructed axially along the sleeve adjacent to this channel. Two insulated plates of a capacitor are installed in this second channel. By sensing the change in capacitance between these plates, the level of various liquids contained between the plates is determined. Because the measurements of these two physical properties, radiation and capacitance, have no effect on each other, it has been found convenient to use a single open channel and measure both electron density and dielectric constant across this single channel.

Raw measurements from these two sensors are reported directly to a microprocessor used as an imbedded controller and located in a chamber within the same sleeve as the sensors. A variable power supply, responsive through the algorithm operating on the microprocessor, whose parameters are determined by the sensor input from the two sensors, is used to provide power to the electric motor which is used to provide power to a multi-stage positive displacement pump. By this method the liquid level within a pumping well can be maintained within the length of the sleeve containing the sensors and microcontroller.

Another object of the present invention is to allow continuous pumping of a well to keep the liquid level and hence the back pressure on the formation nearly constant. To accomplish this, it is necessary to employ a pump that does not compress gas directly back into the liquid hydrocarbon only to allow the associated volumetric contraction to "gas lock" the pump. Volumetric contraction of mixtures of oil and gas can be significant and at various times the well bore fluid may be 100% water based brine which is effectively uncompressible. To cover the widest variety of well production characteristics in low volume wells, a multistage positive displacement pump is preferred. To accommodate the variation in fluid compressibility, each subsequent stage of the positive displacement pump must be reduced in volumetric capability from the previous stage. However, to accommodate the nearly incompressible brines sometimes produced, an interstage pressure relief bypass is required.

These and other features of the invention will be apparent to those of skill in the art from a review of the following detailed description along with the accompanying drawings.

DETAILED DESCRIPTION OF A PREFERRED EMBODIMENT

Figure 1:
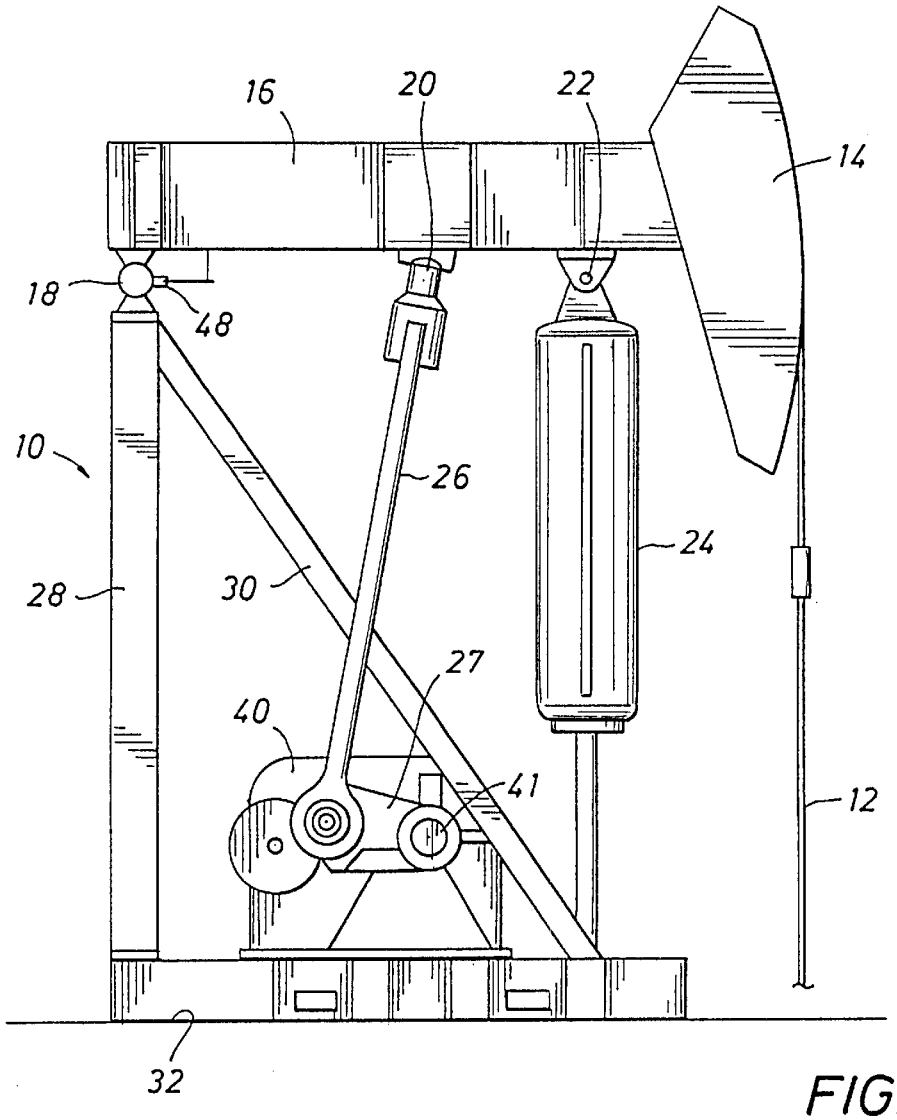
FIG. 1 (PRIOR ART)
FIG. 1 is a schematic diagram of a conventional beam pumping unit showing components necessary for removal of fluid from the well.

FIG. 1 depicts a conventional pumping unit 10 that is well known in the art. The unit of FIG. 1 is provided to give a basic understanding of the field in which the present invention finds application. The unit 10 includes a sucker-rod string 12 that is attached to and moved up and down by a horse's head 14. The horse's head 14 is mounted to the end of a walking beam 16. The walking beam 16 supports three pivot members 18, 20, and 22. The pivot member 22 connects the walking beam 16 to an air receiver tank 24. The pivot member 20 connects the walking beam 16 to a connecting rod 26 and to a crank arm 27. The pivot member 18 connects the walking beam 16 to a Sampson post 28.

The pumping unit further includes a structural member 30 to further provide structural rigidity to the assembly. The structural member 30 connects the Sampson post 28 with a foundation 32 for mechanical support of all of the moving elements of the unit. The pumping unit further includes a motor and reduction gear assembly 40. The motor and reduction gear assembly 40 drives the crank arm 27 and the connecting rod 26 in the familiar combined rotating and oscillating motion to drive to the horse's head 14 and consequently the sucker rod string 12 in the vertical direction. Down hole, and connected to the rod string 12 is a conventional, positive displacement pump (not shown) to pump fluid from the well. As previously described, this arrangement has served well for many years on wells which have adequate volume to justify the expense of the system and the cost of operating such a system. The present invention, however, is directed to wells on which such a system is not economically justified.

Figure 2:
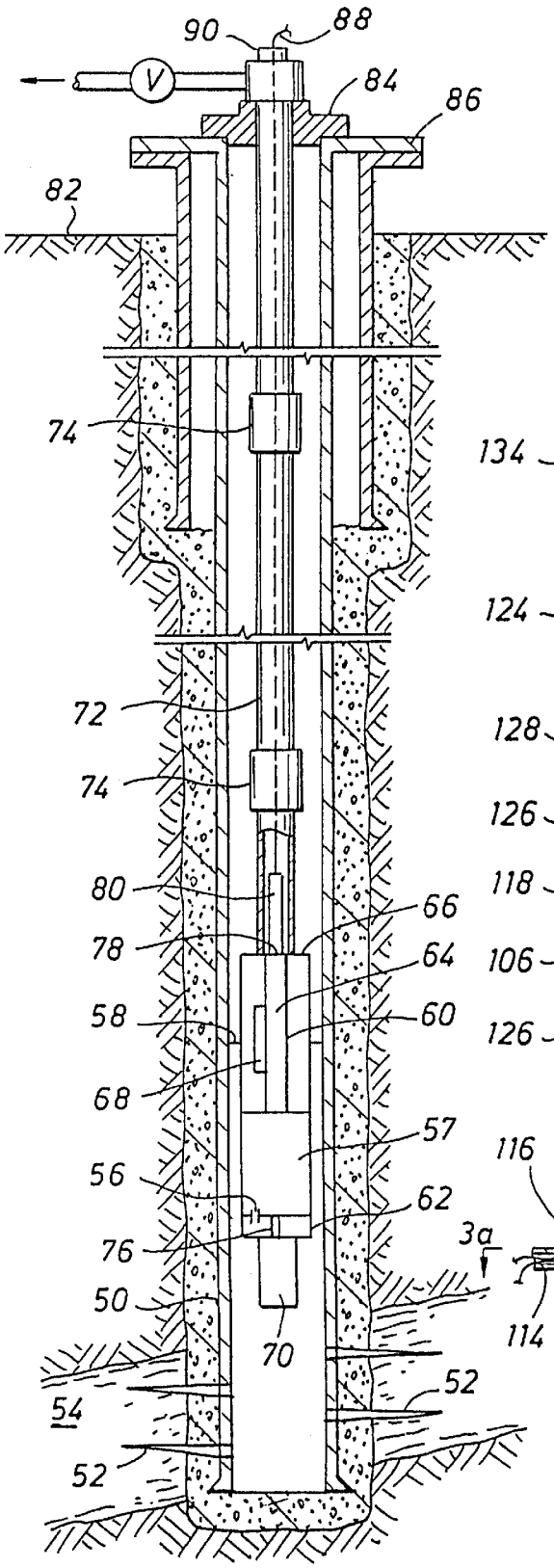
FIG. 2 is an elevational cross sectional view of a well in which the present invention is deployed.

FIG. 2 depicts an overall system diagram of the present invention in which the beam pumping unit of FIG. 1 has been eliminated. Oil and other formation fluids enter a well casing 50 If through a plurality of casing openings or perforations 52 adjacent to producing horizons 54. The producing horizon 54 can intersect the well casing 50 at any vertical position relative to a fluid input 56 into a positive displacement pump 57 so long as the pressure within the producing horizon 54 can achieve a fluid level 58 within the range of a sensor array 60. Fluids entering the well casing 50 are drawn through a well screen 62 into the fluid input 56 of the pump 57. The positive displacement pump 57 delivers fluid into a conduit 64 that extends through a mandrel 66 on which the sensor array 60 is mounted (See FIG. 4) for determining the fluid level 58 and a pump off controller and power interface 68, shown and described below in respect of FIG. 5. The pump off controller and power interface 68 controls the power output of a motor 70 and hence the rate of delivery of fluid from the pump 57 into the conduit 64.

The positive displacement pump 57 is driven by the motor 70 contained within the well bore and located near the lower end of a string of production tubing 72. The production tubing is made up in the conventional manner, with sections of tubing joined together by couplings 74.

A fractional horsepower DC electric motor for this purpose is preferred. However, other appropriate electrical motors and controllers are available and for well depths greater than 4000 feet a multi-phase AC motor may be preferred. To reduce the speed of such a motor and increase the available torque a gear reducer 76 may be employed between the output shaft of the motor 70 and the drive shaft of the pump 57. To achieve mechanical alignment between an offset shaft of the pump 57 and the shaft of the gear reducer 76 or the shaft of the motor 70, if employed without the aid of a gear reducer, a pump coupling may be used. This pump coupling may be a set of interlocking spur gears, a helical coil attachment, a bellows coupler, a magnetic coupler, or any other suitable device.

Figure 3A:
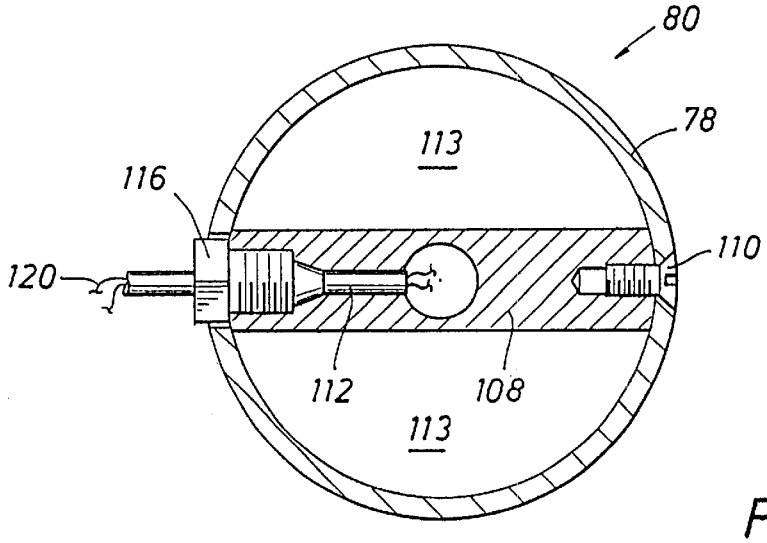
FIG. 3*a* is a top sectional view of the wireline wet connect of FIG. 3 taken along view lines 3*a*–3*a*.
Figure 3:
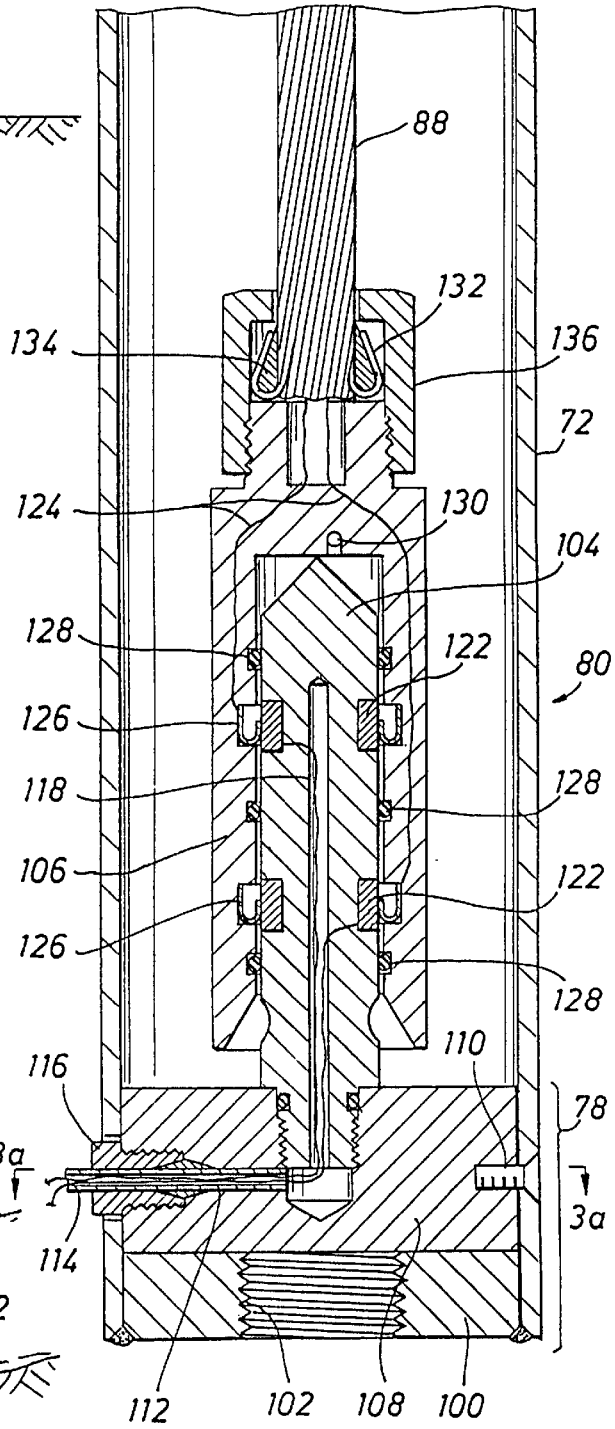
FIG. 3 is an elevational sectional view of a wireline wet connect used in the invention.

At the upper end of the conduit 64, a threaded adapter 78 is attached within which a male member of a wireline wet connect 80 is installed, shown in greater detail in FIG. 3. The threaded adapter 78 allows conductors from the wireline wet connect to be routed to the annulus between the production tubing 72 and the casing 50 while maintaining a pressure seal between the pressures of the conduit and the pressures of the annulus. Also, the threaded adapter 78 allows flow of fluid from the conduit to the interior of the production tubing 72 which extends from the threaded adapter to the Earth's surface 82 where the fluid is collected. The production tubing 72 may be a continuous length of coil tubing, conduit, or it may be conventional production tubing with the production tubing couplings 74. The production tubing is suspended within the well casing by hanging from a tubing hanger 84 that is supported by a Braden head flange 86. A wireline 88, the lower end of which incorporates the female member of the wireline wet connect 80, is suspended from a wireline hanger 90 at the upper end of the production tubing to the threaded adapter. The wireline is preferably an armored electrical wireline. The armored wireline must contain conductors that have sufficient electrical capacity and insulation to withstand the voltage and current necessary to run the motor and associated pump off controller and power interface.

FIG. 3 depicts the wireline wet connect 80. The purpose of the wireline wet connect is to couple the wireline 88 and production tubing 72 to the remaining downhole equipment to thereby support the equipment within the well casing and to make the electrical connection between the power supply on the surface (not shown) and the components of the system powered by the power supply. An adapter plate 100 has threads 102 to attach to the conduit 64 (FIG. 2) and is affixed to the lower end of the threaded adapter 78. The threaded adapter 78 contains a molded male member 104 which slidably mates with a female wet stab 106 attached to the end of the armored wireline. The threaded adapter 78 is constructed of a piece of tubing of the size of the production tubing. A cross tubing support 108 within the threaded adapter 78 provides a base for mounting the male member 104. The cross tubing support 108 is fixed to the threaded adapter 78 by set screws 110 and provides a portal 112 for exit of a length of small diameter hydraulic tubing 114 which is mounted in a conventional tubing compression fitting 116. The tubing 114 allows for passage of wiring from the male member 104 to the pump off controller and power interface 68 mounted in the mandrel (FIG. 2). Optionally, this fitting may be replaced by an electrical bulkhead connector. The male member 104 contains a wire passage 118 that allows connection of electrical conductors 120 from contact rings 122 embedded in the molding and exposed on the radially outer surface of the male member 104.

The female wet stab 106 is illustrated engaged with the male member 104. Another set of electrical conductors 124, these conductors connected to the surface, are contained within the body of the female wet stab 106. These conductors terminate in contact springs 126 so aligned that when the female wet stab is engaged with the male member there is intimate electrical contact between the contact spring 126 and its associated contact ring of the male member 104. O-Rings 128 are positioned within the female wet stab to seal against non-conductive portions of the male member, thereby creating electrical isolation between the contact rings when the male and female members are engaged. A vent hole 130 is provided to allow fluid to escape when the female wet stab is inserted over the molded male member. The female wet stab is suspended from the armored wireline 88 by folding strands of cable armor 132 over a bobbin 134. The bobbin 134 is then inserted into a capture cap 136 which is threaded onto the female wet stab.

FIG. 3*a* shows a top view of the wet connect 80. The cross tubing support 108 is held in place in the threaded adapter 78 on one side by the set screw 110 and on the other side by the tubing compression fitting 116. This leave a flow channel 113 on either side of the cross tubing support 108 for fluid flow from the discharge of the positive displacement pump into the production tubing.

Figure 4:
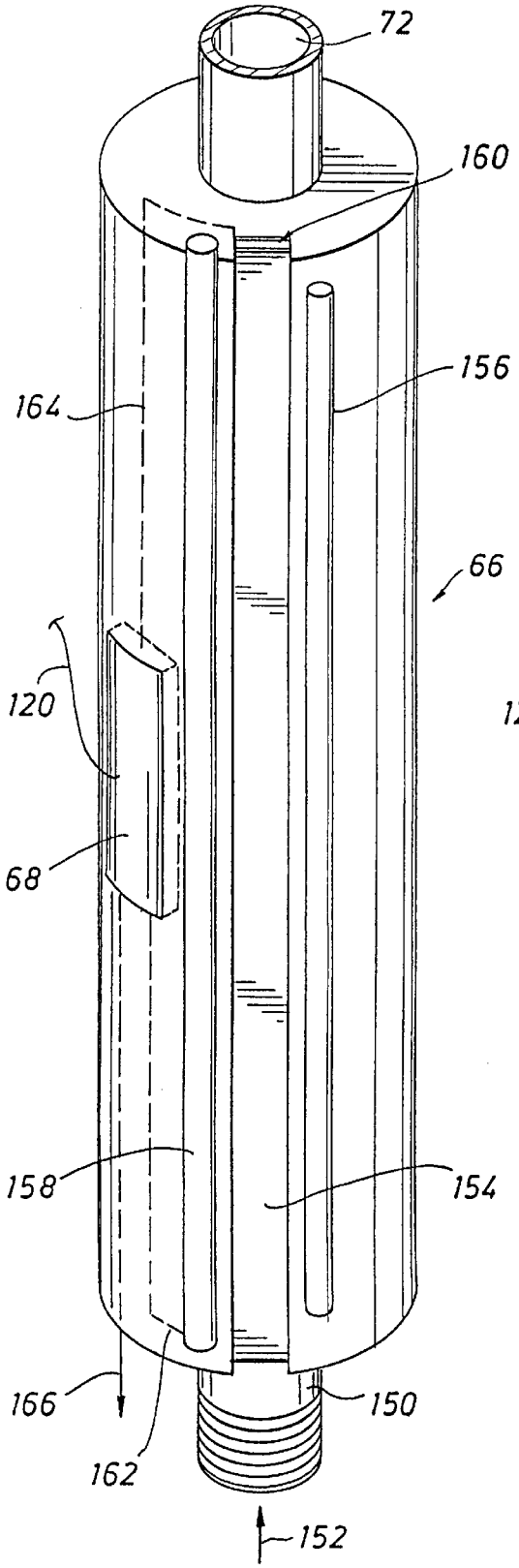
FIG. 4 is a perspective view of a downhole sensor array of the present invention.

Referring now to FIG. 4, a perspective view of the mandrel 66 is shown. As previously described, the mandrel 66 is positioned in the system immediately below the wireline wet connect and is supported by the production tubing 72. The bottom of the mandrel 66 is coupled to a discharge 150 of the positive displacement pump 57 (FIG. 2). Production fluid, typically a mixture of oil and brine flow upward through the mandrel as shown by an arrow 152.

The mandrel is preferably formed of a polymeric material, which advantageously is robust in the harsh, downhole environment, and provides a satisfactory medium for the sensors embedded in the body of the mandrel. The mandrel includes at least one open channel 154 which runs the axial length of the mandrel. The mandrel resides downhole at a position such that fluid level of production fluid will be somewhere along the length of the mandrel. The pump 157 is run at such a rate as to maintain this level approximately constant. As used herein, "approximately constant" means that the level of the fluid in the well is not permitted to rise above the mandrel (and thus the level sensors) and the level is not pumped down below the bottom of the mandrel, which could unload the pump. One channel for each of the sensors may be provided, but since the parameters used for measurements do not interfere with one another, it is preferred to have only the one channel.

The mandrel includes a radioactive source strip 156, made of a radioactive material such as for example 10 $\mu$Curies of cesium or cobalt, or a radioactive mineral such as Uraninite, Davidite, any of the Gummites, such as Camotite, Tyuyamunite, Torbernite and Meta-torbernite, Autunite and Meta-autunite, Uranophane, Schroeckingerite, and the like, as well as other rare minerals which contain cerium, dysprosium, erbium, europium, gadolinium, holmium, lanthanium, lutetium, neodymium, praseodymium, samarium, terbium, niobium, and thulium, such as for example Monazite, Euxenite, Allanite, Samarskite, Bastnasite Cerite, Polycrase, Betafite, Pyrochlore, and Thorite. The source strip is fully embedded in the mandrel and is made of a naturally occurring mineral, and thus poses no health risk or risk of contamination. The radioactive source strip 156 is positioned on one side of the channel 154 and a G-M detector 158 is positioned on the opposite side of the channel. As fluid level in the well changes, the amount of attenuation of the radiation flux (electron density) from the source changes, thereby providing a measurement of the total mass of fluid in the channel.

Also positioned within the channel 154 is an elongate flat plate capacitor 160. The capacitor 160 is made up of two flat, parallel plates, with an open gap between them. Changing level of fluid in the channel changes the capacitance of the capacitor in accordance with the formula:

$$C = \frac{\varepsilon A}{d},$$

where C is capacitance of the capacitor 160, $\in$ is the dielectric constant, A is the area between the plates, and d is the distance between the plates. Changing level of fluid in the channel 154 therefore alters the dielectric constant, and thus this parameter provides level indication. A combination of the signals from the G-M detector and the capacitor 160 thus provides a definitive fluid level in the channel 154, and thus in the well.

As previously described, another feature of the present invention is positioning the controller for the pump adjacent the pump. To this end, the pump off controller and power interface 68 is mounted in a well in the mandrel 66. The interface 68 provides power to the G-M detector over a conductor 162, to the capacitor over a conductor 164, and to the motor 70 over a conductor 166. Power to the interface is provided over the conductors 120 (See FIG. 3).

Figure 4A:
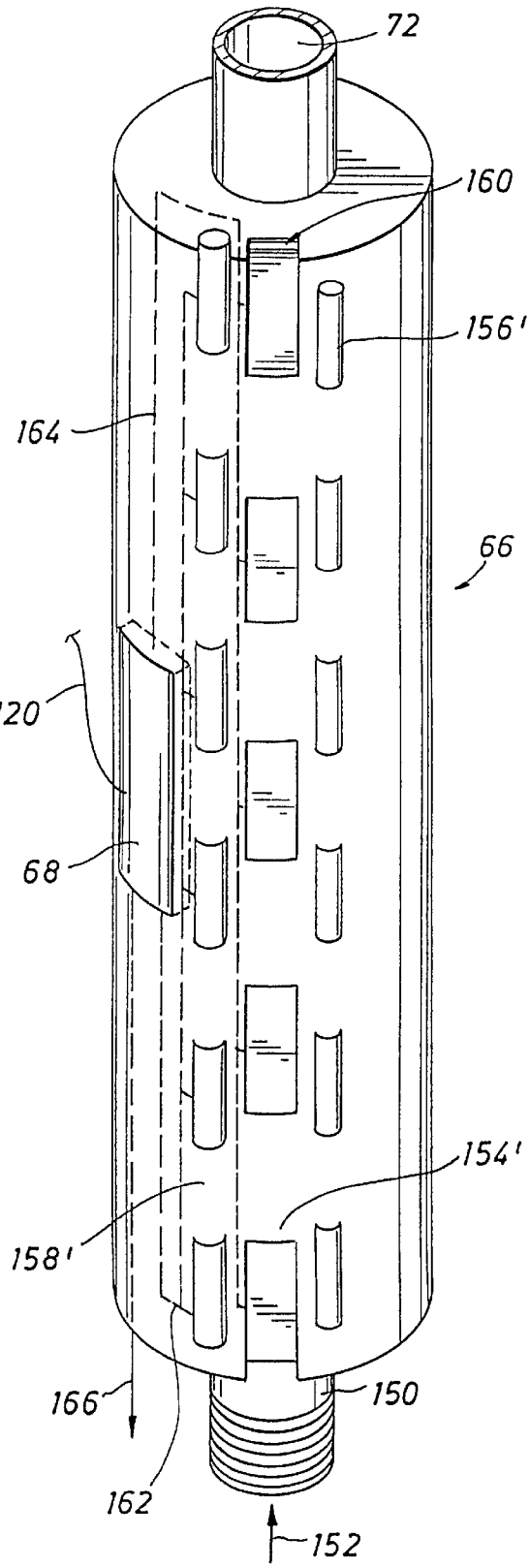
FIG. 4*a* is a perspective view of a downhole sensor array in which a plurality of axially oriented radioactive sources, G-M detectors, and flat plate capacitors are employed.

As shown in FIG. 4*a,* the radioactive source, the G-M detector, and the capacitor may be segmented into a plurality of sources 156', a plurality of small G-M detectors 158', and a plurality of smaller flat plate capacitors 154'. Each of the individual powered components requires a conductor from the power source, as shown in FIG. 4*a*. This embodiment is shown for completeness, but is not the currently preferred embodiment due to the increase in manufacturing costs.

Figure 5:
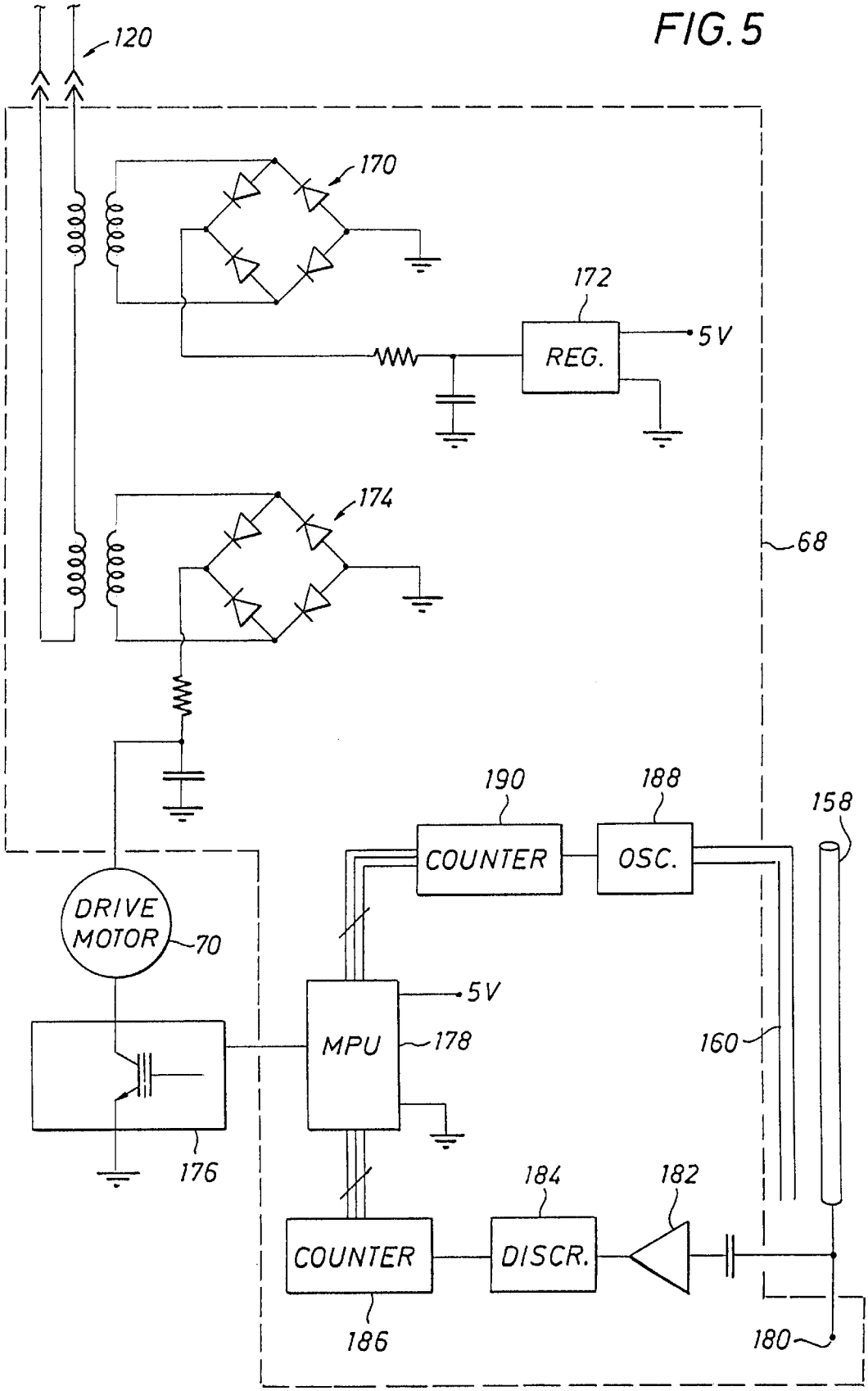
FIG. 5 is an electrical schematic diagram of the electronics of the present invention

FIG. 5 provides further details of these electrical features of the invention, and in particular of the pump off controller and power interface 68. Electrical power, originally from the surface, is provided to the interface by conductors 120. A first full wave bridge rectifier 170 provides power to a regulator 172, to develop regulated power to all the integrated circuits and logic of the interface 68. A second full wave bridge rectifier 174 provide unregulated power to the motor 70 for drive power. The motor operation is controlled by a motor controller 176 which receives operational commands from a microcontroller 178. Further details of the function of the microcontroller 178 are provided in respect of FIG. 6, described below.

The microcontroller 178 receives data from the G-M detector 158 and the capacitor 160, i.e. the level sensors, in making determinations regarding operation of the motor 70. The G-M detector 158 is powered by a high voltage power supply 180, powered by the conductors 120. The signal from the G-M detector feeds a pre-amp/amp 182, a discriminator 184 (which eliminates extraneous spikes in the signal), and a digital counter 186 to give a count rate to the microcontroller 178, which is indicative of the density of the fluid in the channel 154 (FIG. 4). Similarly, the capacitor 160 has a varying capacitance due to the dielectric constant, and this varying parameter is provided to an oscillator 188 and a digital counter 190, to provide data on the dielectric constant to the microcontroller 178. The signals from the G-M detector and the capacitor are combined by the microcontroller for an unambiguous level indication for directing the operation of the motor 70.

Figure 6A:
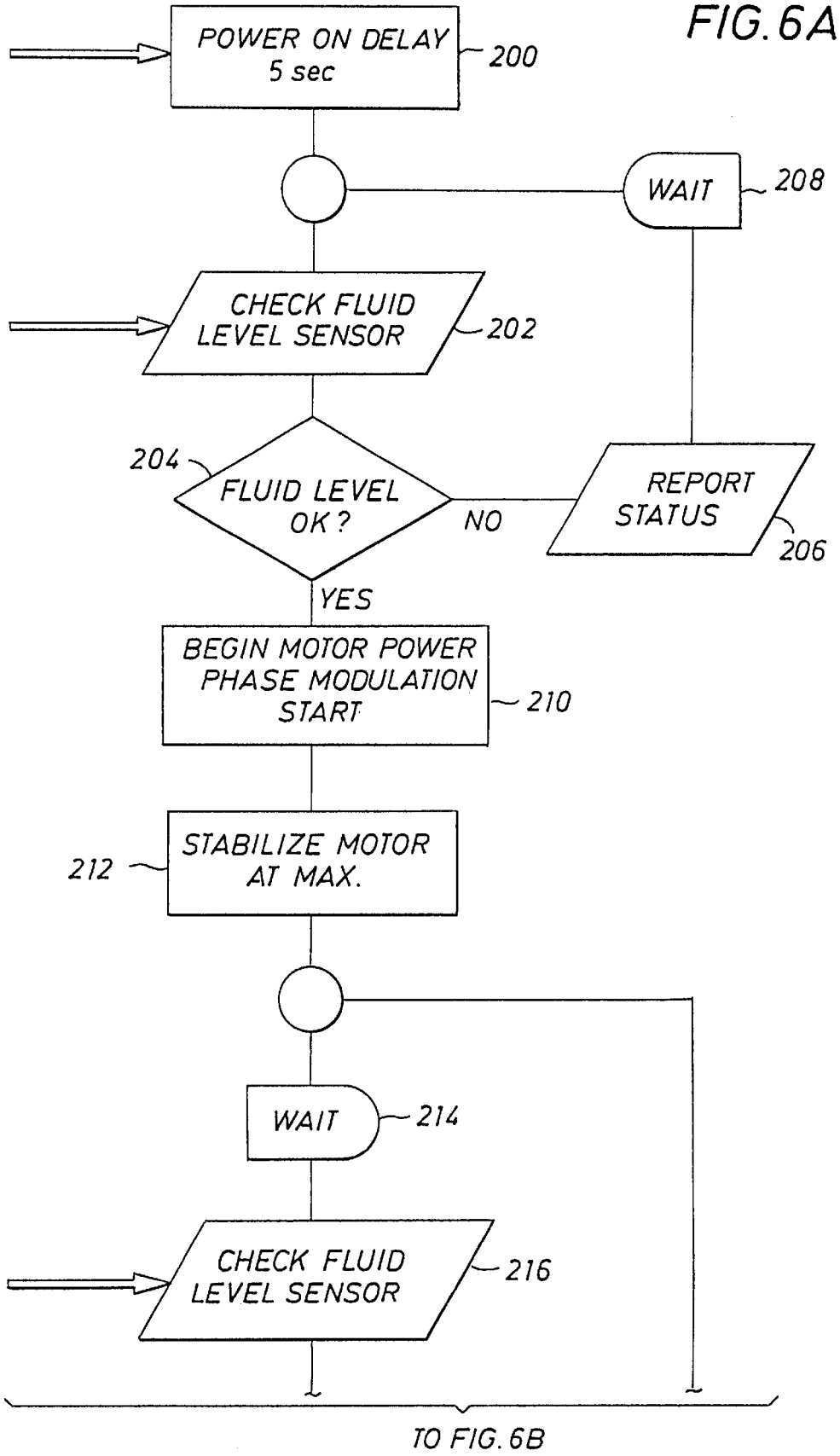
FIG. 6 is a logic flow diagram of the algorithm of the control program of an embedded pump off controller of the invention.
Figure 6B:
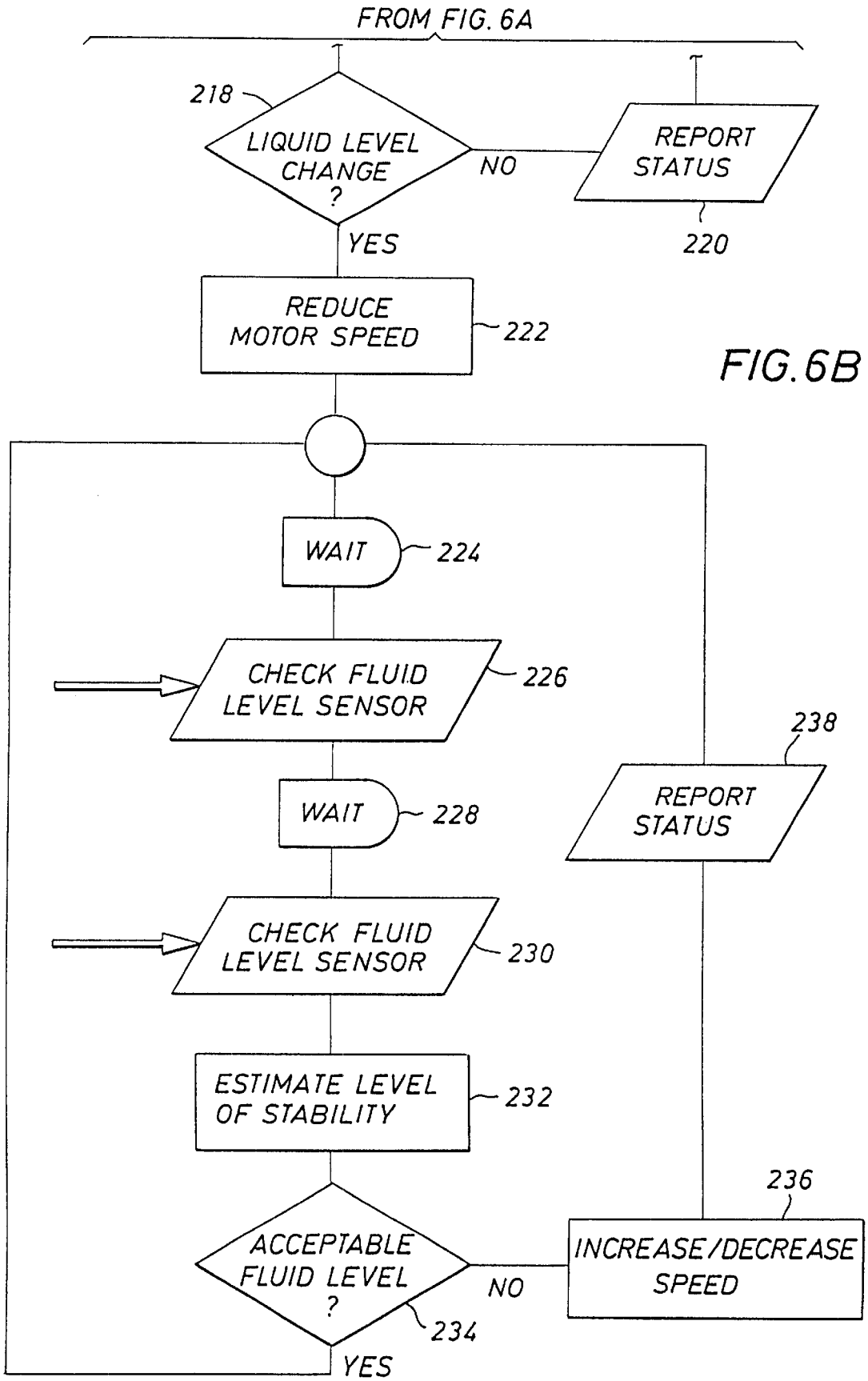

FIG. 6 depicts the basic logic of the microcontroller 178 in maintaining substantially constant fluid level in the well. The logic begins with step 200, in which a power on delay, for example for five seconds, is imposed to permit the system logic and power systems to stabilize. Step 202 checks the G-M and capacitive fluid level sensors, in order to verify that there is fluid in the well for pump operation. A comparison is made in step 204, and if no fluid level is detected, this fact is reported in step 206. The microcontroller then waits in step 208, and returns to step 202.

Once proper level in the well is determined in step 204, then step 210 begins a motor power phase modulation startup. This startup sequence avoids over current conditions when starting the positive displacement pump from a dead start. Motor speed is stabilized at maximum speed in step 212, and then the microcontroller initiates a wait sequence in step 214 to permit the pump to run at maximum rated capacity for a period of time. Presumably, at this stage, the well has a fluid level at or above the level of the level detectors. So, step 216 checks fluid level again, to determine if there has been a fluid level change. If no fluid level change is detected in step 218, the system reports this fact in step 220 and re-initiates the wait sequence of step 214. This cycle is repeated until a level change is detected in step 218, at which point the motor speed is reduced in step 222.

The remainder of the logic alters the pump speed, up or down, to maintain substantially constant fluid level in the well. The wait sequence 224 runs the pump at the now reduced speed for a predetermined period of time. The fluid level sensors are checked again in step 226, and another wait sequence is initiated in step 228. Step 230 involves another fluid level check, for comparison purposes, so that in step 232 a determination is made regarding whether the fluid level is steady and within the normal range of the level sensors. If the fluid level is not acceptable as determined in step 234, then the pump speed is altered up or down in step 236 and a status report is issued in step 238. The wait sequence is again initiated in step 224 and the cycle is repeated until step 234 determines that fluid level has stabilized. Once fluid level has stabilized, the pump speed is maintained steady until fluid level is no longer stable.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the invention.

I claim:

1. A well pumping system comprising:

a. a down hole motor;

b. a down hole pump driven by the motor;

c. a down hole microcontroller adapted to control the operation of the motor;

d. a level sensor providing level data to the microcontroller; and e. a polymeric mandrel above and supporting the pump and motor and further supporting the level sensor.

2. The system of claim 1, wherein the microcontroller is programmed to control the operation of the motor based on data provided by the level sensor.

3. The system of claim 1, wherein the microcontroller is programmed to control the operation of the motor based on data provided by the level sensor to provide a substantially constant fluid level in a well.

4. The system of claim 1, wherein the level sensor comprises a radioactive source and a radiation detector.

5. The system of claim 1, wherein the level sensor comprises a flat plate capacitor.

6. The system of claim 1, wherein the level sensor comprises a radioactive source and a radiation sensor and a flat plate capacitor.

7. The system of claim 1, wherein the mandrel comprises a polymeric material supporting the microcontroller.

8. The system of claim 1, further comprising an axial channel in the mandrel wherein the level sensor comprises a radioactive source and G-M detector mounted in the channel and a flat capacitor mounted in the channel.

9. The system of claim 1, further comprising production tubing supporting the pump and motor.

10. The system of claim 9, further comprising wireline extending through the production tubing and providing electrical power to the motor, the level sensor, and the microcontroller.

11. The system of claim 9, further comprising an axial bore through the mandrel adapted to carry fluid from the pump into the production tubing.

12. The system of claim 1, further comprising a gear reducer between the motor and the pump.

13. The system of claim 1, wherein the pump is a positive displacement pump.

14. The system of claim 1, wherein the motor is a fractional horsepower DC electric motor.

15. A system for maintaining fluid level at a desired pump off level in a well bore extending from the surface of the earth to a producing horizon, the system comprising:

a. a tubular conduit in the well bore extending from the surface of the earth to a point in the well bore below the desired pump off level;

b. a down hole positive displacement pump supported by the tubular conduit;

c. an electric motor coupled to the positive displacement pump;

d. a microcontroller mounted adjacent to the pump and adapted to control the function of the motor;

e. a gear reducer between the motor and the pump;

f. a mandrel between the pump and the conduit, the mandrel having an axial bore therethrough adapted to carry fluid from the pump to the conduit;

g. a channel in the mandrel;

h. a level sensor in the channel, i. wherein the level sensor is adapted to provide sensed fluid level to the microcontroller; and j. wherein the microcontroller is programmed to control the function of the motor to maintain fluid level at a substantially constant desired pump off level in the well bore.

16. The system of claim 15, further comprising a wireline power conductor through the conduit adapted to provide electrical power from the surface of the earth to the motor and the microcontroller.

17. The system of claim 6, further comprising a wet connect coupling the conductor to the motor and the microcontroller.

18. A well pumping system comprising:

a. a down hole motor;

b. a down hole pump driven by the motor;

c. a down hole microcontroller adapted to control the operation of the motor;

d. a level sensor providing level data to the microcontroller; and e. an electrical coupling adapted to couple the power cable to the motor, to the microcontroller, and to the level sensor, the coupling comprising male and female components adapted for slidable engagement and to conduct electrical power between them.

* * * * *